US009056467B2

(12) United States Patent
Yamamori et al.

(10) Patent No.: US 9,056,467 B2
(45) Date of Patent: Jun. 16, 2015

(54) LIQUID EJECTING HEAD UNIT

(75) Inventors: Akio Yamamori, Nagano (JP); Haruhisa Uezawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 362 days.

(21) Appl. No.: 13/271,506

(22) Filed: Oct. 12, 2011

(65) Prior Publication Data

US 2012/0092408 A1 Apr. 19, 2012

(30) Foreign Application Priority Data

Oct. 19, 2010 (JP) ..... 2010-234247

(51) Int. Cl.

| | |
|---|---|
| ***B41J 29/38*** | (2006.01) |
| ***B41J 2/045*** | (2006.01) |
| ***B41J 2/14*** | (2006.01) |

(52) U.S. Cl.

CPC ..... *B41J 2/14274* (2013.01); *B41J 2/04528* (2013.01); *B41J 2/04531* (2013.01); *B41J 2/04563* (2013.01); *B41J 2/04581* (2013.01); *B41J 2202/08* (2013.01); *B41J 2202/12* (2013.01)

(58) Field of Classification Search

USPC ..... 347/10, 17, 68, 86, 5, 9, 14, 15; 374/138; 73/56, 756

See application file for complete search history.

(56) References Cited

U.S. PATENT DOCUMENTS

| | | | | |
|---|---|---|---|---|
| 2004/0045352 | A1 | 3/2004 | Kamiunten et al. | |
| 2008/0205481 | A1 * | 8/2008 | Faries et al. | 374/138 |
| 2011/0041619 | A1 * | 2/2011 | Delbos et al. | 73/756 |
| 2011/0261103 | A1 | 10/2011 | Saga et al. | |

FOREIGN PATENT DOCUMENTS

| | | |
|---|---|---|
| JP | 01-099849 | 4/1989 |
| JP | 03-175049 | 7/1991 |
| JP | 2000-028411 | 1/2000 |
| JP | 2006-133243 | 5/2006 |
| JP | 2007-001128 | 1/2007 |
| JP | 2008-023806 | 2/2008 |
| JP | 2010-131850 | 6/2010 |
| JP | 2010-131943 | 6/2010 |

* cited by examiner

*Primary Examiner* — Lam S Nguyen
(74) *Attorney, Agent, or Firm* — Workman Nydegger

(57) ABSTRACT

A liquid ejecting head unit includes: a liquid ejecting head that ejects a liquid through nozzles by driving a pressure generation element to cause the pressure within a pressure chamber to fluctuate; a flow channel member in which is formed a flow channel that supplies the liquid to a head flow channel of the liquid ejecting head; a substrate, mounted to a side surface of the flow channel member, on which is mounted an electrical component for supplying power to the pressure generation element; and a temperature measurement device provided on the surface of the substrate that faces the flow channel member. Here, the flow channel member includes an opening that passes therethrough toward the flow channel; and the temperature of the liquid within the flow channel is measured by the temperature measurement device that is provided facing the opening.

7 Claims, 4 Drawing Sheets

LIQUID EJECTING HEAD UNIT

The entire disclosure of Japanese Patent Application No: 2010-234247, filed Oct. 19, 2010 is expressly incorporated by reference herein.

BACKGROUND

1. Technical Field

The present invention relates to a liquid ejecting head unit for an ink jet recording head or the like that applies pressure fluctuations to a pressure chamber that communicates with a nozzle and causes a liquid in the pressure chamber to be ejected through the nozzle.

2. Related Art

Ink jet recording heads (called simply "recording heads" hereinafter) used in image recording apparatuses such as ink jet recording apparatuses (called simply "printers" hereinafter), coloring material ejecting heads used in the manufacture of color filters for use in liquid-crystal displays and the like, electrode material ejecting heads used in the formation of electrodes in organic EL (electroluminescence) displays and FEDs (front emission displays) and the like, bioorganic matter ejecting heads used in the manufacture of biochips (biochemical devices), and so on can be given as examples of liquid ejecting heads that eject a liquid within a pressure chamber as liquid droplets through a nozzle by causing a pressure fluctuation to occur within the pressure chamber.

For example, the stated recording head is configured by attaching, to a head case manufactured from a resin, a flow channel unit in which a serial liquid flow channel extending from a reservoir, through the pressure chamber, and to the nozzle is formed, an actuator unit including a pressure generation element capable of causing fluctuations in the volume of the pressure chamber, and so on. Furthermore, a nozzle plate in which a plurality of nozzles are provided is affixed to the stated flow channel unit.

The liquid ejected from such a recording head has a viscosity that is suitable for ejection, such as, for example, approximately 4 mPa·s at normal temperatures. The viscosity of a liquid correlates with the temperature thereof, while the liquid tending to become more viscous at lower temperatures and less viscous at higher temperatures. Although a recording head provided with a heater that heats the liquid is known as a head that allows the viscosity of the liquid to be ejected from the nozzles to be set to a value suitable for ejection regardless of the ambient temperature, it is necessary to change the amount of heat generated by this heater in accordance with the temperature of the flowing liquid. Accordingly, a configuration has been proposed in which, in order to accurately ascertain the temperature of the liquid, a flow channel member through which a liquid flows is formed of a metal having a favorable thermal conductivity, such as aluminum, which reduces the temperature difference between the flow channel member and the liquid, and a temperature sensor (a temperature measurement device) that is mounted on the flow channel member indirectly measures the temperature of the liquid (for example, see JP-A-2010-131943).

Incidentally, in a recording head such as that described above, it takes time for heat to be transferred through the entirety of the metal and for the metal to reach a set temperature, and thus it takes time before an accurate liquid temperature can be obtained. Furthermore, because the flow channel member is formed of a metal, it is difficult to form the flow channel member, and also leads to an increase in costs. This also increases the weight of the recording head.

SUMMARY

It is an advantage of some aspects of the invention to provide a liquid ejecting head unit capable of quickly and accurately measuring the temperature of a liquid within a flow channel.

A liquid ejecting head unit according to an aspect of the invention includes: a liquid ejecting head that ejects a liquid through a nozzle by driving a pressure generation element to cause the pressure within a pressure chamber to fluctuate; a flow channel member in which is formed a flow channel that supplies the liquid to a head flow channel of the liquid ejecting head; a substrate, mounted to a side surface of the flow channel member, on which is mounted an electrical component for supplying power to the pressure generation element; and a temperature measurement device provided on the surface of the substrate that faces the flow channel member. Here, the flow channel member includes an opening that passes therethrough toward the flow channel in an area that opposes the temperature measurement device; and the temperature of the liquid within the flow channel is measured by the temperature measurement device that is provided facing the opening.

According to this configuration, the temperature measurement device is provided facing the opening that passes through the flow channel and the temperature of the liquid within the flow channel is measured, which makes it possible to measure the temperature of the liquid within the flow channel quickly and accurately. In addition, the opening need only pass through the flow channel member, and thus the processing can be carried out easily. Furthermore, the flow channel member can be formed of a resin or the like, and thus there is no major increase in the weight of the liquid ejecting head unit.

In the aforementioned configuration, it is preferable that the temperature measurement device be provided so as to make contact with the liquid within the flow channel.

According to this configuration, the accuracy with which the temperature of the liquid within the flow channel is measured can be improved.

In the aforementioned configuration, it is preferable that the surface of the temperature measurement device be covered by a protective film, and that the temperature of the liquid within the flow channel be measured through the protective film.

According to this configuration, degradation, wear, and so on of the temperature measurement device caused by contact with the liquid can be prevented.

According to another aspect of the invention, it is preferable that the configuration be such that a metal heat-transfer member that makes contact with the liquid within the flow channel is inserted into the opening; and that the metal heat-transfer member and the temperature measurement device make contact with each other on the opposite side to the flow channel.

According to this configuration, degradation, wear, and so on of the temperature measurement device caused by contact with the liquid can be prevented with certainty.

According to another aspect of the invention, it is preferable that the configuration be such that the temperature measurement device and the metal heat-transfer member are joined by a thermally-conductive adhesive.

According to this configuration, the temperature measurement device and the metal heat-transfer member can be strongly anchored to each other, which makes it possible to prevent the temperature measurement device and the metal heat-transfer member from separating from each other.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
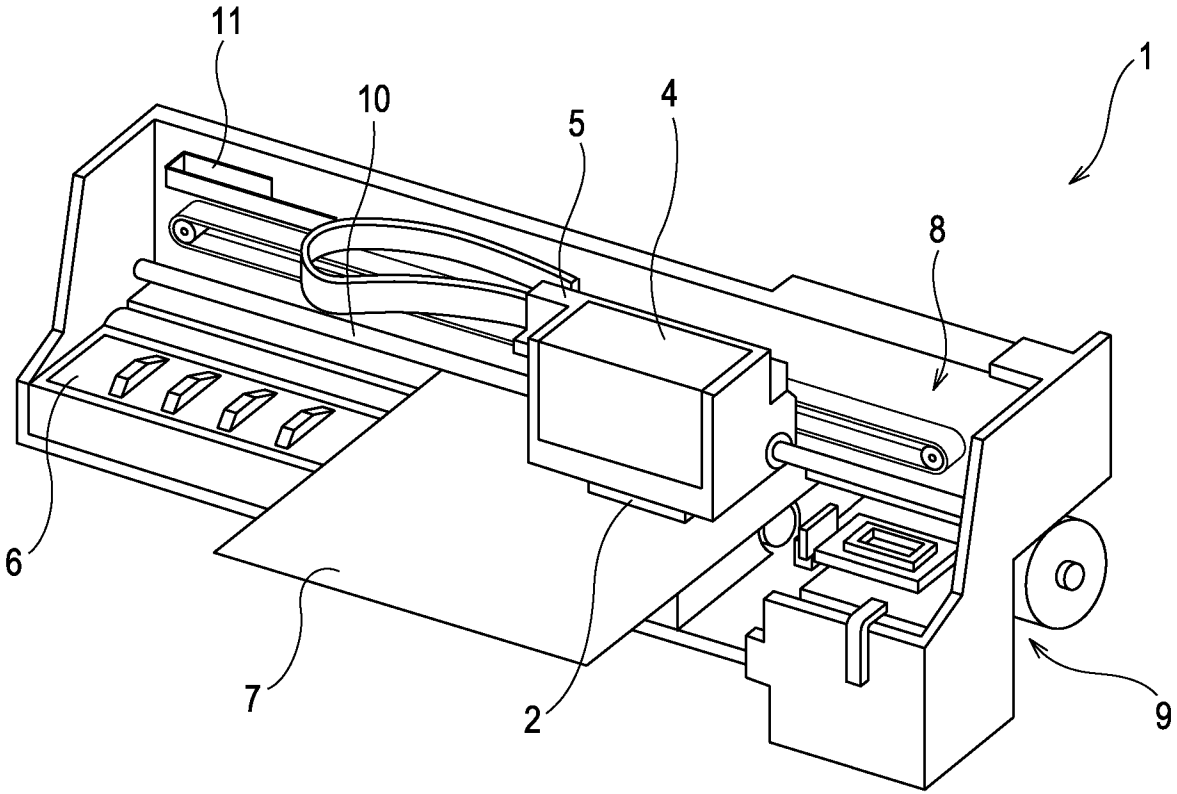
FIG. 1 is a perspective view of a printer.

Hereinafter, embodiments of the invention will be described with reference to the appended drawings. Although various limitations are made in the embodiment described hereinafter in order to illustrate a specific preferred example of the invention, it should be noted that the scope of the invention is not intended to be limited to this embodiment unless such limitations are explicitly mentioned hereinafter. Hereinafter, an ink jet recording apparatus 1 (called simply a "printer" hereinafter) as illustrated in FIG. 1 will be described as an example of a liquid ejecting apparatus.

The printer 1 is provided with an ink jet recording head unit 2 (called simply a "recording head unit" hereinafter), serving as a type of liquid ejecting head unit, and the printer 1 is generally configured so as to include: a carriage 5 to which the recording head unit 2 and an ink cartridge 4 are attached; a platen 6 that is disposed below the recording head unit 2; a carriage movement mechanism 8 that moves the carriage 5, in which the recording head unit 2 is mounted, in the paper width direction of recording paper 7 (a type of landing target on which liquid ejected through nozzles 38 lands); a paper feed mechanism 9 that transports the recording paper 7 in a paper feed direction, which is the direction orthogonal to the paper width direction; and so on. Here, the paper width direction corresponds to the main scanning direction (the direction in which the recording head unit 2 moves back and forth), whereas the paper feed direction corresponds to the sub scanning direction (that is, the direction orthogonal to the scanning direction of the recording head unit 2).

The carriage 5 is attached in a state in which it is axially supported by a guide rod 10 that is spanned along the main scanning direction, and the configuration is such that the carriage 5 moves in the main scanning direction along the guide rod 10 as a result of operations performed by the carriage movement mechanism 8. The position of the carriage 5 in the main scanning direction is detected by a linear encoder 11, and detection signals are sent to a control unit (not shown) as location information. Accordingly, the control unit can control recording operations (ejection operations) and the like of the recording head unit 2 while recognizing the scanning location of the carriage 5 (the recording head unit 2) based on the location information from the linear encoder 11.

The recording head unit 2 is attached to a lower area of the carriage 5 (an area toward the recording paper when recording operations are being carried out). Meanwhile, the ink cartridge 4, which holds ink (a type of liquid), is attached to the carriage 5 in a removable state. Furthermore, the recording head unit 2 includes, in its upper area, a sub tank 12 that holds ink, and the configuration is such that the ink within the ink cartridge is introduced into the recording head unit as a result of the sub tank 12 communicating with the interior of the ink cartridge 4.

Figure 2A:
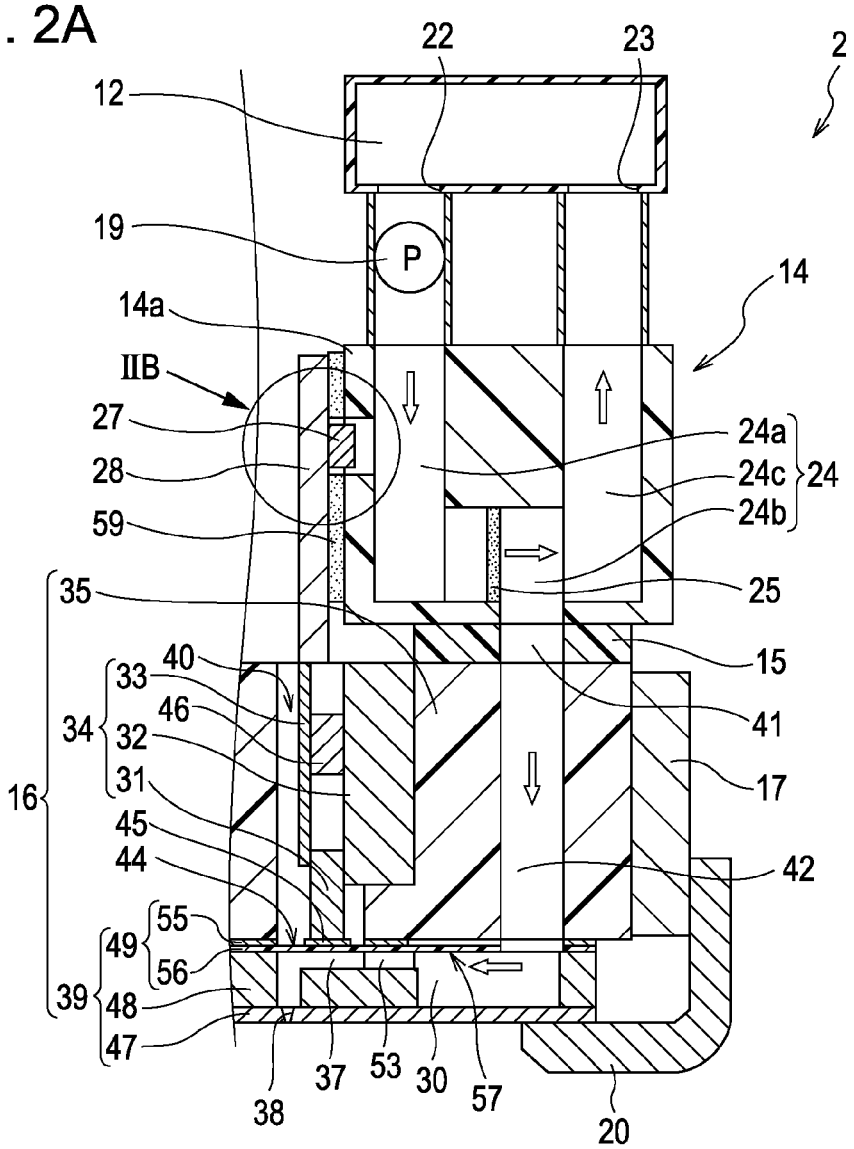
FIG. 2A is a cross-sectional view illustrating the main part of a liquid ejecting head unit according to a first embodiment.
Figure 2B:
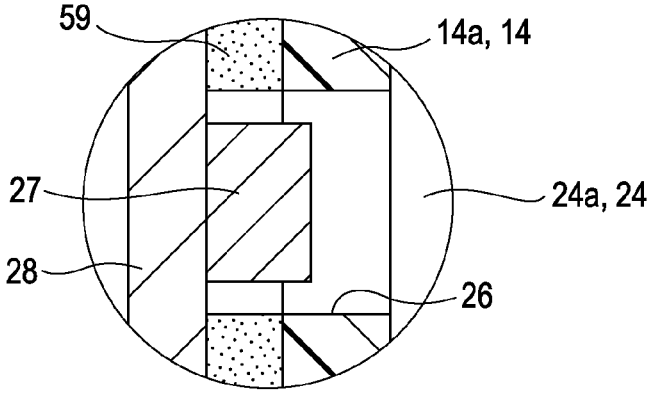
FIG. 2B is an enlarged view of a region IIB.

Next, the configuration of the recording head unit 2 will be described in detail. FIG. 2A is a cross-sectional view illustrating the main part of the recording head unit 2, whereas FIG. 2B is an enlarged view of a region IIB shown in FIG. 2A. The recording head unit 2 according to this embodiment is configured so as to include: the sub tank 12; a flow channel member 14 connected to a lower area of the sub tank 12; a substrate 28 mounted on a side surface of the flow channel member 14; an ink jet recording head 16 (called simply a "recording head" hereinafter) connected to a lower area of the flow channel member 14 via a connection member 15; a heater 17 mounted to a side surface of the recording head 16; and a head cover 20 that protects a lower area of the recording head 16. Note that the recording head unit 2 according to this embodiment is symmetrical on the right and left in a cross-section that is orthogonal to the main scanning direction (see FIG. 2A), and thus the configuration of only one side thereof will be described hereinafter, and descriptions of the configuration of the other side, which is symmetrical to the stated one side, will be omitted.

The sub tank 12 is a hollow box-shaped member configured of a resin or the like, and communicates with the ink cartridge 4, which is positioned thereabove, via a liquid introduction pin or the like (not shown). Accordingly, the ink within the ink cartridge is introduced into and held within the sub tank. Furthermore, an ink discharge opening 22 and an ink introduction opening 23 that communicate with a cyclical flow channel 24 in the flow channel member 14, which will be mentioned later, are provided in a lower area of the sub tank 12; the ink within the sub tank can be introduced into the flow channel member via the ink discharge opening 22, and the ink within the flow channel member can be discharged into the sub tank via the ink introduction opening 23.

The flow channel member 14 is a box-shaped member in which the cyclical flow channel 24 (a supply flow channel 24*a* and a discharge flow channel 24*c*), which connects to a lower area of the sub tank 12, projects upward, and includes: the cyclical flow channel 24 formed therewithin; a pump 19 that is attached partway along the cyclical flow channel 24; and a filter 25 that is mounted within the cyclical flow channel 24. The flow channel member 14 according to this embodiment is formed of a resin or the like that has insulation properties. The cyclical flow channel 24 is a flow channel configured so that the ink can cycle therethrough via the sub tank 12. The cyclical flow channel 24 is configured of: a supply flow channel 24*a*, whose upper end protrudes, communicating with the ink discharge opening 22 of the sub tank 12, and that extends downward from the ink discharge opening 22 (toward the recording head); a filter mounting portion 24*b* that communicates with the lower end of the supply flow channel 24*a* and that extends in the direction that is orthogonal to the supply flow channel 24*a* when viewed as a cross-section; and the discharge flow channel 24*c*, whose lower end communicates with the end of the filter mounting portion 24*b* that is on the opposite side as the end that is connected to the supply flow channel 24*a*, and whose upper end protrudes, communicating with the ink introduction opening 23 of the sub tank 12. Furthermore, in this embodiment, the pump 19 is mounted partway through the supply flow channel 24*a*, and the ink can be caused to cycle by pushing out the ink using the pressure of the pump 19. In other words, the ink within the sub tank cycles around by passing through the ink discharge opening 22, the supply flow channel 24*a*, the filter mounting portion 24*b*, the discharge flow channel 24*c*, and the ink introduction opening 23, and once again entering into the sub tank 12 (that is, cycles in the direction indicated by the arrows in FIG. 2A). Note that this ink cycling is executed by driving the pump 19 when the recording head 16 is standing by (that is, when recording operations are not being carried out), and can suppress the ink from thickening.

Meanwhile, an opening 26 is provided in a side wall 14*a* on the inner side of the flow channel member 14 (the side that is closer to a vibration element unit 34, which will be mentioned later), passing through from the surface of the side wall 14*a* toward the cyclical flow channel 24 (the supply flow channel 24*a*, in this embodiment). The opening 26 is formed so as to have a size that is capable of housing a thermistor 27 (this corresponds to a temperature measurement device according to the invention), which will be mentioned later, and is sealed by affixing the substrate 28, on which the thermistor 27 is mounted, to the side surface of the flow channel member 14 in a fluid-tight state. Note that this configuration will be described in detail later. Furthermore, an opening for communicating with a common liquid flow channel 42, which will be mentioned later, is provided in part of the base area of the filter mounting portion 24*b*. The filter 25, which has approximately the same diameter as the filter mounting portion 24*b*, is provided on the edge of the opening that communicates with the common liquid flow channel 42, on the side that is located toward the common liquid flow channel (that is, forward in the cyclical flow channel of the ink) (see FIG. 2A). The filter 25 is configured, for example, by interweaving fine metal filaments in a mesh shape, and can filter the ink that moves from the cyclical flow channel to the common liquid flow channel 42. During recording operations, some of the filtered ink is sent to the recording head through the opening provided in the base area of the filter mounting portion 24*b*. In other words, ink is supplied to the common liquid flow channel 42 of the recording head 16 from the cyclical flow channel 24. Note that the cyclical flow channel 24 corresponds to a flow channel according to the invention.

Next, the configuration of the recording head 16 will be described in detail. The recording head 16 according to this embodiment is configured so as to include: a vibration element unit 34 in which a piezoelectric vibration element 31 (a type of pressure generation element), an anchoring plate 32, and a flexible cable 33 are integrated as a single unit; a head case 35 capable of housing the vibration element unit 34; and a flow channel unit 39 that forms a serial flow channel extending from a reservoir 30 (a common ink chamber) to the nozzles 38 via a pressure generation chamber 37 (this corresponds to a pressure chamber according to the invention).

The head case 35 is a hollow box-shaped member configured of a resin such as an epoxy resin; the flow channel member 14 is joined to the upper side thereof via the connection member 15, whereas the flow channel unit 39 is joined to the lower side thereof (that is, the opposite side to the side to which the flow channel member 14 is joined). In addition, a housing cavity 40 and the common liquid flow channel 42 are formed in the head case 35. The housing cavity 40 is formed in a position that opposes the side wall 14*a* on the inner side of the flow channel member 14, further inside than the common liquid flow channel 42, and houses the vibration element unit 34, which is a type of actuator. The upper end of the common liquid flow channel 42 communicates with the filter mounting portion 24*b* of the flow channel member 14 via a connection flow channel 41 of the connection member 15, whereas the lower end of the common liquid flow channel 42 communicates with the reservoir 30 of the flow channel unit 39. Note that the connection member 15 is a flexible sealing member formed of an elastomer or the like, and the common liquid flow channel 42 and filter mounting portion 24*b* are connected in a fluid-tight state by the connection flow channel 41 of the connection member 15.

Next, the flow channel unit 39 will be described. As shown in FIG. 2A, the flow channel unit 39 is formed from a nozzle plate 47, a flow channel formation substrate 48, and a vibrating plate 49, and is joined to the head case 35 on the side that is opposite to the side on which the nozzle plate 47 is provided. The flow channel unit 39 is formed as a single integrated unit, with the nozzle plate 47 disposed on one surface of the flow channel formation substrate 48 and the vibrating plate 49 disposed on the other surface of the flow channel formation substrate 48, on the side opposite to the side on which the nozzle plate 47 is disposed; these elements are layered in this manner and affixed to each other.

The nozzle plate 47 is a thin stainless-steel plate in which a plurality of nozzles 38 are provided in a row at a pitch corresponding to the dot formation density. In this embodiment, for example, 180 nozzles 38 are provided in a row, and a nozzle row is thus formed by these nozzles 38.

The flow channel formation substrate 48 is a plate-shaped member, configured of the reservoir 30, an ink supply opening 53, and the pressure generation chamber 37, that forms a serial ink flow channel. Specifically, the flow channel formation substrate 48 is a plate-shaped member in which a plurality of cavities that serve as a plurality of pressure generation chambers 37, which communicate with corresponding nozzles 38, are formed in a row and separated by partitions, and in which a plurality of cavities serving as the ink supply openings 53 and reservoirs 30 are formed corresponding to respective pressure generation chambers 37. The flow channel formation substrate 48 according to this embodiment is manufactured by etching a silicon wafer. The aforementioned pressure generation chambers 37 are formed as long, thin chambers extending perpendicularly relative to the direction of the row of nozzles 38 (a nozzle row direction), and the ink supply openings 53 are formed as arteries, having a narrow flow width, that communicate between the pressure generation chambers 37 and the reservoirs 30. The upper areas of the reservoirs 30, meanwhile, communicate with the sub tank 12 via the common liquid flow channel 42, the connection flow channel 41, and the cyclical flow channel 24, and communicate with corresponding pressure generation chambers 37 via the ink supply openings 53. Accordingly, the reservoirs 30 can supply the ink held in the sub tank 12 to the respective pressure generation chambers 37. Note that the serial flow channel configured of the common liquid flow channel 42, the reservoir 30, the ink supply opening 53, and the pressure generation chamber 37 corresponds to a "head flow channel" according to the invention.

The vibrating plate 49 is a composite plate having a dual-layer structure in which a resin film 56 such as PPS (polyphenylene sulfide) has been laminated on a support plate 55 made of a metal such as stainless steel or the like, and is configured so that an opening passes therethrough in the vertical direction in a location that corresponds to the bottom end of the common liquid flow channel 42, thus making it possible for the common liquid flow channel 42 and the reservoir 30 to communicate. Furthermore, the vibrating plate 49 includes a diaphragm portion 44, for causing the volume of the pressure generation chamber 37 to fluctuate, while sealing one opening surface of the pressure generation chamber 37; a compliance portion 57 that seals one opening surface of the reservoir 30 is formed in the vibrating plate 49. The compliance portion 57 is configured only of the resin film 56, with the support plate 55 having been completely removed through etching based on the shape of the opening of the reservoir 30. The diaphragm portion 44, meanwhile, is configured by etching the support plate 55 in a location corresponding to the pressure generation chamber 37 so as to remove a ring-shaped portion from that location, thereby forming a plurality of insular portions 45 to be joined with the free end of the piezoelectric vibration element 31 of the vibration element unit 34. Note that similar to the planar shape of the pressure generation chamber 37, each insular portion 45 has a long, thin block shape extending perpendicularly relative to the direction of the row of nozzles 38, and the resin film 56 surrounding the insular portion 45 functions as an elastic membrane.

Next, the vibration element unit 34 will be described. The vibration element unit 34 is a type of actuator, and is configured of the piezoelectric vibration element 31, the anchoring plate 32, and the flexible cable 33. Specifically, the piezoelectric vibration element 31 is a thin member that is longer in the vertical direction, and a plurality of piezoelectric vibration elements 31 are formed by cutting a piezoelectric vibration plate, serving as a base material, into a comb-tooth shape having extremely thin teeth of approximately several tens of μm each. The piezoelectric vibration elements 31 are configured as longitudinally-vibrating piezoelectric vibration elements 31 capable of extending and retracting in the vertical direction. Each piezoelectric vibration element 31 has its anchored end joined to the anchoring plate, with its free end projecting further than the leading edge of the anchoring plate 32, and is thus anchored in a so-called cantilever state. The tip of the free end of each piezoelectric vibration element 31 is, as described earlier, joined to the insular portion 45 of which the diaphragm portion 44 in the flow channel unit 39 is configured. The anchoring plate 32 that supports each piezoelectric vibration element 31, meanwhile, is configured of a metallic plate rigid enough to arrest the reactive force from the piezoelectric vibration element 31, and in this embodiment, is manufactured from a stainless steel plate approximately 1 mm thick. One end of the flexible cable 33 is electrically connected to the side of the piezoelectric vibration element 31 that is on the opposite side to the anchoring plate 32, and the other end is connected to the substrate 28, which will be described later. Note that a control IC 46 is mounted on the surface of the flexible cable 33, and control such as the driving of the piezoelectric vibration elements 31 is carried out based on control signals from the substrate 28 and the control IC 46.

In this manner, the free end of the piezoelectric vibration element 31 can be caused to extend and retract by driving the piezoelectric vibration element 31 joined to the stated insular portion 45, which makes it possible to cause the volume of the pressure generation chamber 37 to fluctuate. Pressure fluctuations occur in the ink within the pressure generation chamber as a result of this volume change. The recording head 16 ejects (discharges) ink droplets through the nozzles 38 by using such pressure fluctuations.

Next, the substrate 28 will be described. The substrate 28 according to this embodiment is a board member, on one surface of which are mounted electrical components for the supply of electricity to the piezoelectric vibration elements 31 (that is, electrical components, connectors, and so on for controlling the driving of the piezoelectric vibration elements 31), and on the other surface of which the flow channel member 14, on which the thermistor 27 serving as a temperature sensor is mounted, covers the side surfaces. Part of the substrate 28 is connected to a wire (not shown) from the control unit. One end of the flexible cable 33 is, as mentioned earlier, connected to a lower area of the substrate 28. Accordingly, control signals and the like can be sent to the piezoelectric vibration elements 31 from the control unit, and temperature measurement values can be sent to the control unit from the thermistor 27. The substrate 28 is then mounted to a side surface of the flow channel member in a state in which the surface on which the thermistor 27 is mounted faces the flow channel member. Here, the thermistor 27 is mounted on the substrate in a location that opposes the aforementioned opening 26 of the flow channel member 14, and the configuration is such that the thermistor 27 faces the opening 26 when the substrate 28 is mounted on the side of the flow channel member 14. In this embodiment, the thermistor 27 that is mounted is slightly smaller than the opening 26, and the configuration is such that part of the thermistor 27 is contained within the opening when the substrate 28 is mounted on the side surface of the flow channel member 14 (see FIG. 2B). Accordingly, the ink that flows through the cyclical flow channel 24 comes into contact with the thermistor 27, and thus the temperature of the ink within the cyclical flow channel 24 can be measured by the thermistor 27. Based on the measured value, the amount of heat emitted by the heater 17 that heats the liquid is determined. Note that an adhesive 59 may be applied to the areas where the substrate 28 and the side wall 14*a* of the flow channel member 14 overlap, thus creating a fluid-tight seal, in order to mount the substrate 28 on the flow channel member 14. In addition, the substrate 28 according to this embodiment is formed of a member that has insulative properties, thus preventing the heat from the ink from escaping into the atmosphere from the flow channel member 14. Furthermore, the surface of the substrate 28 on which the thermistor 27 is mounted is covered by an insulating film on the areas thereof aside from where the thermistor 27 is mounted, thus preventing short-circuits from occurring in the substrate 28 in rare cases where ink has leaked from the cyclical flow channel 24.

Next, the heater 17 that heats the liquid will be described. The heater 17 according to this embodiment is provided on a side surface of the recording head 16. Specifically, the heater 17 is mounted using the adhesive 59 or the like, whose thermal conductivity is high (for example, 2 ($W \cdot m^{-1} \cdot K^{-1}$)), so as to cover the entire side surface of the head case 35 opposing the common liquid flow channel 42. Furthermore, the heater 17 is configured in sheet form (that is, in film form), with an electrically heated wire (a nickel alloy, stainless steel, or the like) being surrounded by a polyimide resin or the like, and emits heat when a current flows through the electrically heated wire. As a result of the heat emitted by the heater 17, the ink within the common liquid flow channel can be heated through the head case 35. As mentioned earlier, by adjusting the amount of heat emitted by the heater 17 based on the temperature information measured by the thermistor 27, the ink within the recording head is adjusted to a predetermined temperature. Note that in this embodiment, the temperature of the ink within the supply flow channel 24*a* is measured, and thus the temperature of the ink can be measured immediately before the ink is introduced into the recording head 16; then, the amount of heat emitted by the heater 17 can be adjusted based on the temperature information of the ink that will be heated thereafter by the heater 17. Furthermore, as shown in FIG. 2A, part of the head cover 20 makes contact with a bottom area of the outer surface of the heater 17.

This head cover 20 is created from, for example, a thin, metallic plate member, and is a protective member that protects the side and base areas of the flow channel unit 39. The upper end of the head cover 20 makes contact with the heater 17, and is bent approximately 90 degrees toward the nozzle plate from the heater side (that is, from the side surface of the head case 35); the head cover 20 is then anchored to an end area of the nozzle plate 47. Accordingly, the heat from the heater 17 is transferred to the nozzle plate 47 through the head cover 20, heating the nozzle plate 47 as a result. Through this, the ink within the flow channel unit can be heated. Note that the nozzle plate 47 can furthermore be prevented from being charged by grounding the head cover 20.

As described thus far, the thermistor 27 is provided facing the opening 26 that is in turn provided to pass through the cyclical flow channel 24, and thus the temperature of the liquid within the cyclical flow channel is measured; this makes it possible to quickly and accurately measure the temperature of the liquid within the flow channel. In this embodiment, a configuration in which the ink within the cyclical flow channel 24 makes contact with the thermistor 27 is employed, and thus the accuracy of the measurement can be improved. Furthermore, the heater temperature is quickly controlled in accordance with the value of the measurement, which makes it possible to further stabilize the temperature of the ink within the recording head unit. As a result, discrepancies in the viscosity of the ink can be suppressed, which makes it possible to improve the reliability of the recording head unit 2. In addition, the opening 26 need only pass through the flow channel member 14, and thus this processing can be carried out easily using a press or the like. Furthermore, because the flow channel member 14 is formed of a resin or the like, there is no major increase in the weight of the recording head unit 2. In addition, the thermistor 27 is mounted on the substrate 28 that drives the piezoelectric vibration element 31, making it possible to share the wiring of the two, thus improving the ease with which the wiring is carried out during assembly. Note that a configuration is also possible in which the thermistor 27 according to the stated first embodiment is covered with a protective film and measures the temperature of the liquid within the flow channel through the protective film. According to such a configuration, degradation, wear, and so on of the thermistor 27 caused by contact with the ink can be prevented.

The configuration in which the thermistor 27 faces the opening 26 is not limited to the aforementioned first embodiment. For example, FIGS. 3A to 4B illustrate second and third embodiments, respectively, that serve as other such embodiments.

Figure 3A:
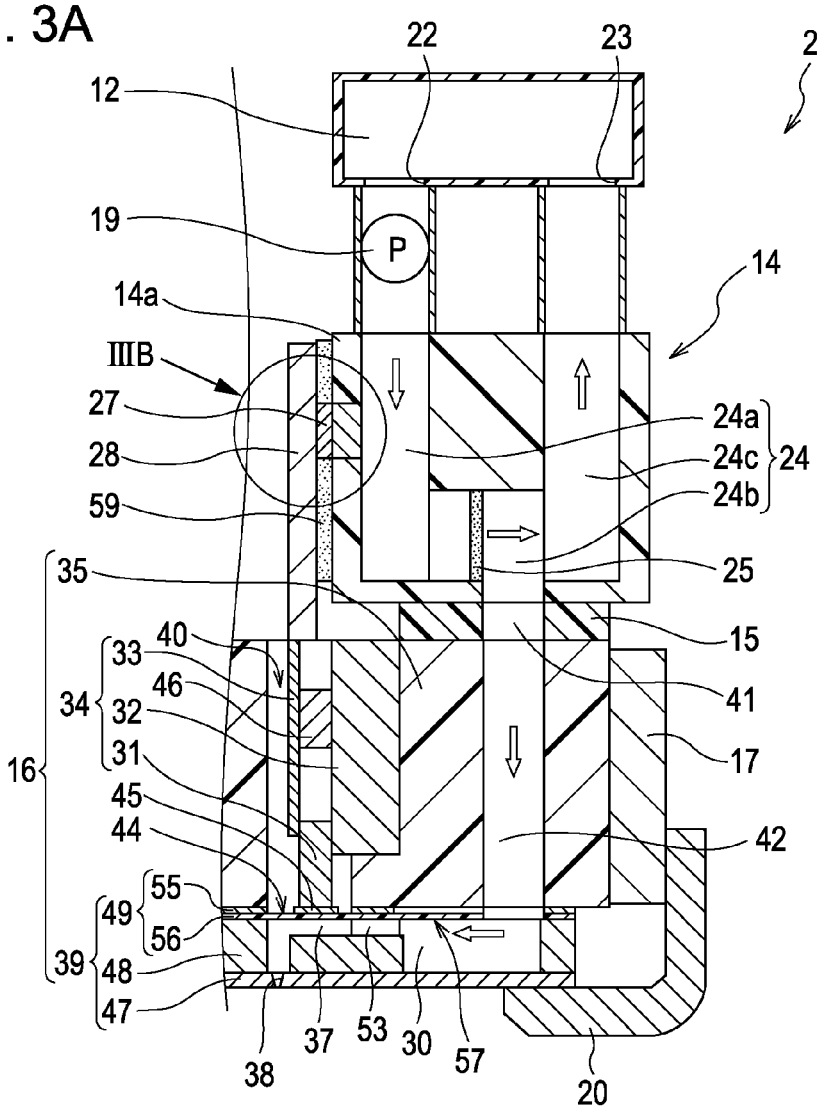
FIG. 3A is a cross-sectional view illustrating the main part of a liquid ejecting head unit according to a second embodiment.
Figure 3B:
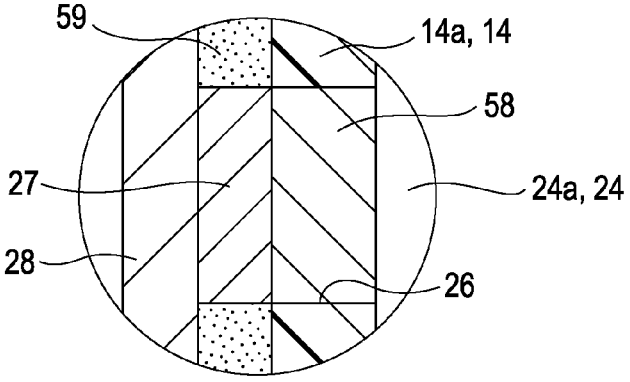
FIG. 3B is an enlarged view of a region IIIB.

As shown in FIG. 3B, a metal (stainless steel, aluminum, or the like) heat-transfer member 58 having a high thermal conductivity is inserted into the opening 26 according to the second embodiment in a fluid-tight state. The metal heat-transfer member 58 has the same thickness as the side wall 14*a* in the opening 26, and configures part of the cyclical flow channel 24 having been inserted into the opening 26. Accordingly, the metal heat-transfer member 58 makes contact with the ink within the cyclical flow channel 24. On the other hand, the thermistor 27 makes contact with the metal heat-transfer member 58 on the side thereof that is on the opposite side as the cyclical flow channel 24. The thermistor 27 measures the temperature of the ink within the cyclical flow channel 24 through the metal heat-transfer member 58. Note that in this embodiment, the substrate 28 and the flow channel member 14 are affixed to each other at the position where the substrate 28 and the side wall 14*a* of the flow channel member 14 overlap by applying the adhesive 59 at a thickness equal to that of the thermistor 27, and thus the position where the metal heat-transfer member 58 and the thermistor 27 are connected to each other is flush with the side wall surface. Because other configurations are identical to those described in the first embodiment, descriptions thereof will be omitted here.

The thermistor 27 is caused to make contact with the metal heat-transfer member 58 in this manner, and thus degradation, wear, and so on in the thermistor 27 caused by contact with the ink can be prevented with certainty. In addition, the thermistor 27 is provided facing the opening 26 that is in turn provided to pass through the cyclical flow channel 24, and measures the temperature of the liquid in the cyclical flow channel 24 through the metal heat-transfer member 58, which has a high thermal conductivity; this makes it possible to quickly and accurately measure the temperature of the liquid within the flow channel. Furthermore, the heater temperature is quickly controlled in accordance with the value of the measurement, which makes it possible to further stabilize the temperature of the ink within the recording head unit. As a result, discrepancies in the viscosity of the ink can be suppressed, which makes it possible to improve the reliability of the recording head unit 2. In addition, the opening 26 need only pass through the flow channel member 14, and thus this processing can be carried out easily using a press or the like. Furthermore, because the flow channel member 14 is formed of a resin or the like, there is no major increase in the weight of the recording head unit 2. In addition, the thermistor 27 is mounted on the substrate 28 that drives the piezoelectric vibration element 31, making it possible to share the wiring of the two, thus improving the ease with which the wiring is carried out during assembly.

Figure 4A:
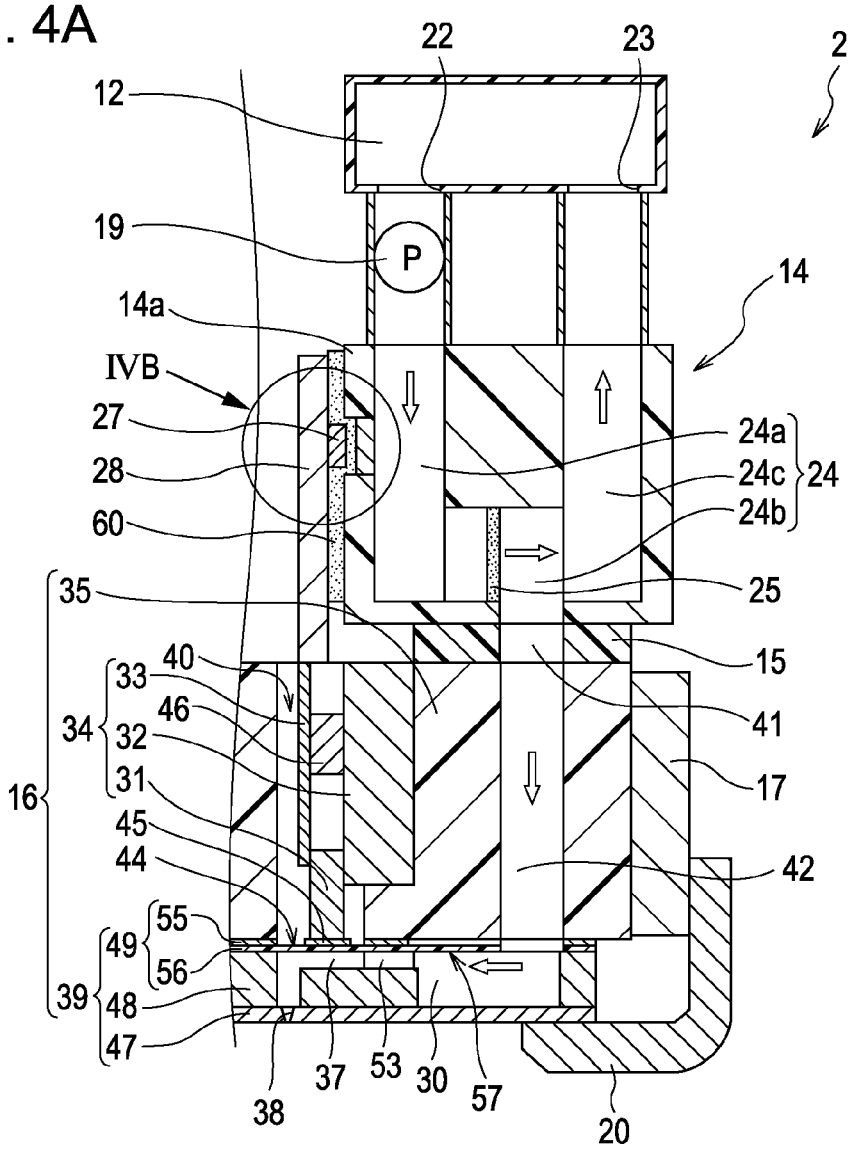
FIG. 4A is a cross-sectional view illustrating the main part of a liquid ejecting head unit according to a third embodiment.
Figure 4B:
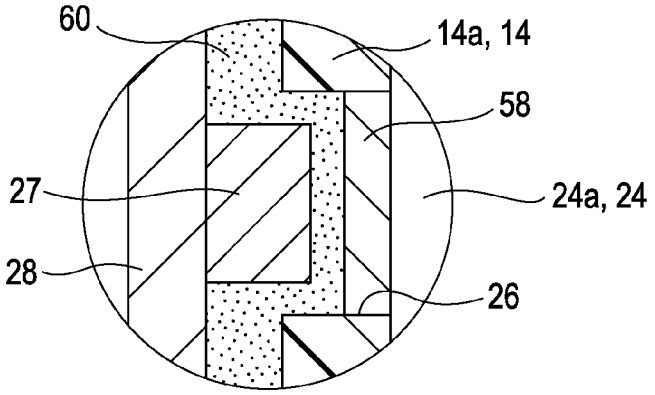
FIG. 4B is an enlarged view of a region IVB.

As shown in FIG. 4B, in a third embodiment, the metal heat-transfer member 58, which has a high thermal conductivity, is inserted into the opening 26 in a fluid-tight state, and the metal heat-transfer member 58 and thermistor 27 are joined using a thermally-conductive adhesive 60. The metal heat-transfer member 58 in this embodiment is formed so as to be thinner than the side wall 14*a* in the opening 26, and is made flush with the side wall 14*a* of the flow channel member 14 on the side of the surface of the cyclical flow channel. Accordingly, the surface of the metal heat-transfer member 58 facing the substrate is formed in a position that is recessed toward the cyclical flow channel beyond the surface of the side wall 14*a* that faces the substrate. The thermally-conductive adhesive 60, which has a high thermal conductivity (a thermally-conductive silicon adhesive, a thermally-conductive epoxy adhesive, or the like), is then applied to the side of the substrate 28 that faces the flow channel member and the entire surface of the thermistor 27, and the substrate 28 and flow channel member 14 are joined. At this time, the thermistor 27 is anchored with the thermally-conductive adhesive 60 sandwiched between the thermistor 27 and the metal heat-transfer member 58, and part of the thermistor 27 is contained within the opening. Accordingly, the thermistor 27 can measure the temperature of the ink within the cyclical flow channel 24 through the metal heat-transfer member 58 and the thermally-conductive adhesive 60. Note that because other configurations are identical to those described in the first embodiment, descriptions thereof will be omitted here.

Because the thermistor 27 and the metal heat-transfer member 58 are strongly anchored using the thermally-conductive adhesive 60, the thermistor 27 and the metal heat-transfer member 58 can be prevented from separating due to warping or the like of the substrate 28 caused by heat or the like. In addition, the thermistor 27 is provided facing the opening 26 that is in turn provided to pass through the cyclical flow channel 24, and measures the temperature of the liquid in the cyclical flow channel 24 through the metal heat-transfer member 58 and the thermally-conductive adhesive 60, which have a high thermal conductivity; this makes it possible to quickly and accurately measure the temperature of the liquid within the flow channel. Furthermore, the heater temperature is quickly controlled in accordance with the value of the measurement, which makes it possible to further stabilize the temperature of the ink within the recording head unit. As a result, discrepancies in the viscosity of the ink can be suppressed, which makes it possible to improve the reliability of the recording head unit 2. Further still, because the thermistor 27 and the ink do not come into direct contact with each other, the degradation, wear, and so on of the thermistor 27 can be prevented with certainty. In addition, the opening 26 need only pass through the flow channel member 14, and thus this processing can be carried out easily using a press or the like. Furthermore, because the flow channel member 14 is formed of a resin or the like, there is no major increase in the weight of the recording head unit 2. In addition, the thermistor 27 is mounted on the substrate 28 that drives the piezoelectric vibration element 31, making it possible to share the wiring of the two, thus improving the ease with which the wiring is carried out during assembly.

Although the aforementioned embodiments describe an example of a configuration in which the heater is provided on a side surface of the recording head, the invention is not limited thereto. For example, the heater may be provided in the flow channel member. Furthermore, although unevenness in the viscosity of the ink is suppressed and the reliability of the recording head unit is increased by heating the ink using a heater, the invention is not limited thereto. For example, a configuration is also possible in which the driving properties (voltage waveform and the like) of the piezoelectric vibration element are changed in accordance with a viscosity that corresponds to the measured temperature information. That is, for example, in the case where the viscosity is high, the ink is made easier to eject by increasing the voltage difference applied to the piezoelectric vibration element. Conversely, in the case where the viscosity is low, the voltage difference applied to the piezoelectric vibration element is reduced. Through this, it is possible to obtain constant ink ejection properties, regardless of the viscosity. Furthermore, by changing the driving waveform in accordance with the temperature of the ink, the reliability of the recording head unit can be increased.

In addition, although the aforementioned embodiments describe a cyclical channel as an example of the flow channel, the invention is not limited thereto. For example, the invention can also be applied in the case where the sub tank and the recording head are connected by a flow channel that is not cyclical, and rather proceeds in one direction. In this case, it is also possible to employ a configuration in which the sub tank is not provided, and the ink cartridge and recording head are connected directly. Furthermore, the ink cartridge may be provided outside of the carriage (on the side of frame of the printer or the like) (this is known as an "off-carriage type"). In this case, the ink within the ink cartridge is sent to the sub carriage by connecting the ink cartridge to the sub carriage using a tube or the like.

Furthermore, although a piezoelectric vibration element in a so-called longitudinally-vibrating mode is described in the above embodiments as an example of a pressure generation unit, the pressure generation unit is not limited thereto. For example, the invention can also be applied when using a piezoelectric vibration element in a so-called flexural vibration mode, a thermal element, or the like.

Finally, the invention is not limited to a printer, and can be applied in a plotter, a facsimile apparatus, a copy machine, or the like; various types of ink jet recording apparatuses; liquid ejecting apparatuses aside from recording apparatuses, such as, for example, display manufacturing apparatuses, electrode manufacturing apparatuses, chip manufacturing apparatuses; and so on.

What is claimed is:

1. A liquid ejecting head unit comprising:

a liquid ejecting head that ejects a liquid through a nozzle by driving a pressure generation element to cause the pressure within a pressure chamber to fluctuate;

a flow channel member in which is formed a flow channel that supplies the liquid to a head flow channel of the liquid ejecting head;

a substrate, mounted to an inner side surface of a side wall of the flow channel member, on which is mounted an electrical component for supplying power to the pressure generation element; and a temperature measurement device provided on the surface of the substrate that faces the flow channel member, wherein the flow channel member includes an opening that opens toward the flow channel; and the temperature of the liquid within the flow channel is measured by the temperature measurement device that is provided facing the opening, wherein the opening defines a recess in the flow channel member, the recess extending from an outer side surface of the side wall of the flow channel member to a surface of the substrate and including the inner side surface of the flow channel member, the recess enclosing the entire temperature measurement device, the temperature measurement device projecting from the surface of the substrate into the recess such that at least a portion of the side wall between the inner and outer side surfaces surrounds the temperature measurement device, wherein the recess opening is flush with the outer side surface of the flow channel, the surface of the substrate having the temperature measurement device provided thereon being opposite the recess opening such that no part of the temperature measurement device projects into the flow channel.

2. The liquid ejecting head unit according to claim 1, wherein the temperature measurement device is provided so as to make contact with the liquid within the flow channel.

3. The liquid ejecting head unit according to claim 2, wherein the surface of the temperature measurement device is covered by a protective film, and the temperature of the liquid within the flow channel is measured through the protective film.

4. The liquid ejecting head unit according to claim 1, wherein a metal heat-transfer member that makes contact with the liquid within the flow channel is inserted into the opening; and the metal heat-transfer member and the temperature measurement device make contact with each other on the opposite side to the flow channel.

5. The liquid ejecting head unit according to claim 4, wherein the temperature measurement device and the metal heat-transfer member are joined by a thermally-conductive adhesive.

6. The liquid ejecting head unit according to claim 1, wherein the flow channel member is formed of a resin.

7. The liquid ejecting head unit according to claim 1, further comprising a metal heat-transfer member that makes contact with the liquid within the flow channel and seals the opening.

* * * * *